United States Patent [19]

Suzuki

[11] Patent Number: 4,635,434

[45] Date of Patent: Jan. 13, 1987

[54] PROTECTIVE DEVICE FOR A GRINDER OR THE LIKE

[76] Inventor: Ken'ichi Suzuki, 1824-3 Sakai, Kashiwa-shi, Chiba-ken, Japan

[21] Appl. No.: 711,726

[22] Filed: Mar. 14, 1985

[51] Int. Cl.[4] ..... B24B 55/06

[52] U.S. Cl. ..... 57/273

[58] Field of Search ..... 51/268, 273; 144/252 R; 408/67; 29/DIG. 84

[56] References Cited

U.S. PATENT DOCUMENTS

| | | | |
|---|---|---|---|
| 2,006,108 | 6/1935 | Montuori | 51/273 |
| 3,119,602 | 1/1964 | Johnson | 51/273 |
| 3,673,744 | 7/1972 | Oimocn | 51/273 |
| 3,935,678 | 2/1976 | Marton | 51/273 |
| 4,135,334 | 1/1979 | Rudiger | 51/273 |
| 4,245,437 | 1/1981 | Marton | 51/273 |
| 4,462,381 | 7/1984 | Fushiya | 51/273 |
| 4,531,329 | 7/1985 | Huber | 51/273 |

FOREIGN PATENT DOCUMENTS

| | | | |
|---|---|---|---|
| 21032 | 5/1974 | Japan | 51/273 |
| 211467 | 12/1982 | Japan | 51/170 T |

*Primary Examiner*—Roscoe V. Parker

*Attorney, Agent, or Firm*—Oldham, Oldham & Weber Co.

[57] ABSTRACT

A protective device for a grinder or the like comprises a cup-shaped guard cover to be attached to the grinder body, which is adapted to enclose a grinding wheel of the grinder and provided with a suction port and a contractible portion. The contractible portion is effectively contracted when the grinder is pressed against a workpiece in use, consequently to prevent swarf particles created in grinding from being scattered by the air evacuated from the suction port and safeguard a worker against a broken piece of the grinding wheel brought about accidentally.

6 Claims, 5 Drawing Figures

PROTECTIVE DEVICE FOR A GRINDER OR THE LIKE

BACKGROUND OF THE INVENTION

1. Field of the Invention:

This invention relates to a protective device for a grinder or the like, and particularly to a protective device which is attached to a concrete grinder, concrete cutting machine or the like for the purpose of preventing concrete swarf particles brought about by grinding or polishing a concrete material from being scatterd in the air.

2. Description of the Prior Art:

Generally, plane grinding or polishing of a workpiece of concrete, for example, has been carried out by use of a grinding or sanding machine having a grinding or sanding wheel composed of abrasives including diamond grains and gives rise to scattering of swarf particles of concrete which tends to injure the health of a worker and invite danger of causing the worker to lose sight of the working portion of a workpiece, thereby decreasing the work efficiency. Though the abrasives such as diamond grains constituting the grinding wheel have of course remarkably high hardness, there is a possibility that the abrasives peel off from one cause or another while grinding and are dispersed in the air, thereby to injure the health of the worker. As one possible way for effectively collecting the swarf particles thus brought about and lessening the danger that the worker carelessly touches the rotating grinding wheel, attempts are now being made to mount a guard cover on the grinding or sanding machine. The guard cover serves to fence about the grinding or cutting wheel and effectively collect swarf particles by imbibing the air around the grinding wheel by suction. In the case where the guard cover made of hard material such as a metal is used, the grinding or cutting wheel has to be exposed in part to the outside of the guard cover. However, if the grinding wheel is put a little out of the guard cover, the work of grinding or cutting often becomes onerous, thereby decreasing the work efficiency is decreased. Otherwise, if the grinding wheel is protruded to excess out of the guard cover to facilitate the grinding work, the guard cover may possibly be deprived of its function as a safeguard. Namely, the adjustment on the guard cover in relation to the grinding wheel turns out to be a very troublesome chore.

In the case of a guard cover made of rubber, for instance, if the grinding wheel should be broken, it is doubtful whether the guard cover can prevent the broken piece from flying apart. Further, the guard cover of rubber is irregularly deformed and suffers a gradual decline in performance due to prolonged use. One example similar to this protective device having such a guard cover has earlier been proposed by the inventor of this invention as a protective device for a grinder or the like in Japanese Utility Model Application Public Disclosure Nos. Sho. 59-24257, 59-66569. The proposed protective device is so designed that the guard cover made of elastic material such as hard rubber encloses the grinding wheel under normal conditions and is elastically contracted to partly expose the grinding wheel in use. However, there is a case where the protective device of this type is unstably deformed as described in the foregoing, whereby the work of grinding becomes relatively troublesome.

OBJECT OF THE INVENTION

In view of the above, the object of this invention is to provide a protective device to be attached to a grinder or the like for the purpose of effectively collecting swarf particles produced by grinding or cutting a workpiece such as of concrete so as to prevent the harmful swarf particles from being scattered in the air thereby keeping a worker from being affected in health and further safeguard the worker against the broken piece brought about when the grinding wheel is broken off, whereby the grinding or cutting work can be carried out with high efficiency in safety.

SUMMARY OF THE INVENTION

In order to achieve the object described above, the protective device for a grinder or the like according to this invention comprises a cup-shaped guard cover adapted to enclose a grinding wheel of the grinder and provided with a suction port which communicates with a suction pump device and a contractible portion capable of being deformed or contracted so as to reduce the height of the cup-shaped guard cover.

The cup-shaped guard cover has its lower end surface placed somewhat lower than or level with the lower surface of the grinding or cutting wheel. The contractible portion may be formed at the relatively upper portion of the cup-shaped guard cover in the shape of circumferential grooves or bellows, for example. Otherwise, the contractible portion may be formed merely by making the upper portion of the cup-shaped guard cover thinner. With this construction, the protective device constituted of the cup-shaped guard cover can stably be contracted resulting in a remarkable improvement in grinding or polishing work.

BRIEF DESCRIPTION OF THE DRAWINGS

Other objects and features of the present invention will be apparent from the ensuing detailed description in connection with the accompanying drawings, wherein.

DESCRIPTION OF THE PREFERRED EMBODIMENTS

This invention relates to a protective device for a grinder or the like, which is adapted to effectively collecting swarf particles brought about by grinding or polishing a workpiece such as of concrete.

Figure 1:
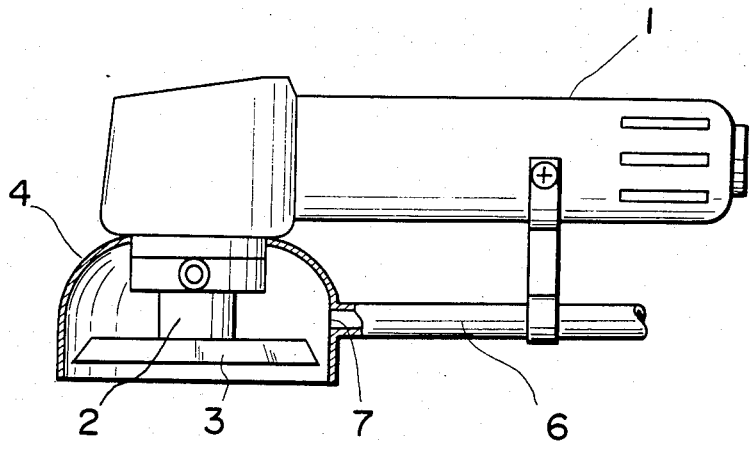
FIG. 1 PRIOR ART
FIG. 1 is a partly broken away side view of a prior art protective device for a grinder.

Before describing the protective device according to this invention, a prior art example (Japanese Utility Model Application Public Disclosure Nos. Sho. 59-24257, 59-66569) will be described with reference to FIG. 1.

The example is constituted of a base body 1 of a grinder having a grinding wheel 3 which is composed of abrasives including grains of diamond or rigid material and attached to the rotating shaft 2 of a driving motor (not shown), and a cup-shaped guard cover 4 formed of elastic material having adequate rigidity, such as rubber and polyurethane. The cup-shaped guard cover 4 adapted to enclose the grinding wheel 3 of the grinder may be detachably attached to the base body 1 of the grinder by use of, for example, a clamping band with screws, or fixedly attached thereto. When the guard cover 4 is attached to the base body, the grinding wheel 3 is placed higher than the lower end surface of the guard cover 4.

Denoted by 6 is a suction pipe adapted to communicate a suction port 7 bored in the side portion of the guard cover 4 to a suction pump device (not shown).

At the time when the grinder with the guard cover having the aforementioned construction is put in use, the guard cover 4 attached to the base body 1 of the grinder is pressed against a workpiece such as a concrete plate while rotating the grinding wheel 3 and exhausting the air around the grinding wheel 3 from the suction port 7 via the suction pipe 6. Then, the elastic guard cover 4 is elastically deformed at the upper portion thereof, consequently to permit the rotating grinding wheel 3 to come into contact with the workpiece. Swarf particles created from the workpiece as a result of grinding or polishing are exhausted along with the air flowing into the suction pipe 6 through the suction port 7 without being scattered in all directions.

However, the guard cover 4 of the construction described above cannot always fulfil its contracting function because the upper portion of the guard cover is not stably deformed.

The present invention was made in view of this point, and aims at providing a protective device for a grinder or the like, which is capable of stably effecting the contraction thereof in use and effectively collecting swarf particles created by grinding or polishing a workpiece such as of concrete.

Figure 2:
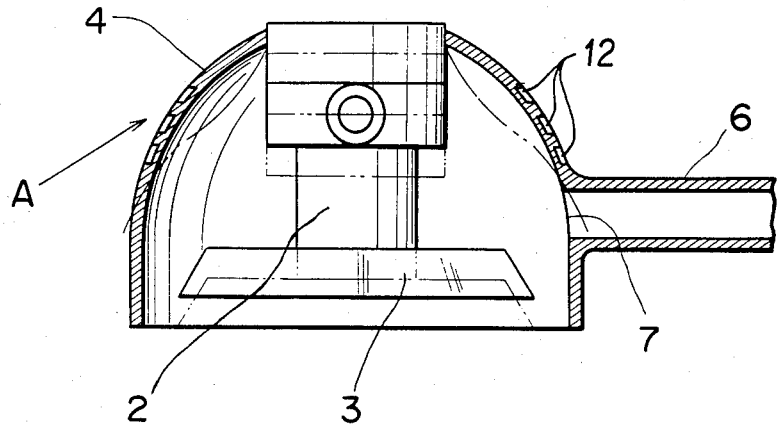
FIG. 2 is a broken away side view of one embodiment of the protective device according to this invention.

The following is a description of one preferred embodiment of this invention with reference to FIG. 2, wherein the elements denoted by the same reference numerals as those in the prior art structure described above are equivalent in function to those in the prior art structure and will not be explained again here.

In the first embodiment as illustrated in FIG. 2, the guard cover 4 attached to the base body 1 of the grinder is provided at the upper portion thereof with a contractible portion A capable of being elastically bent or deformed. The contractible portion A comprises a plurality of circumferential grooves 12 formed in the surface of the guard cover 4.

When the grinder having the aforementioned construction is put in use, the worker holds the base body 1 thereof and presses the guard cover 4 at its lower edge against the workpiece such as a concrete plate. At this time, the grinding wheel 3 is rotated and the suction pump device is driven to cause the air around the grinding wheel 3 to be drawn in through the suction port 7 and the suction pipe 6.

If the guard cover 4 comes into light touch with the surface of the workpiece, the grinding wheel 3 is not yet brought in contact with the workpiece. By further pressing the base body 1 toward the workpiece, the guard cover is deformed at the contractible portion to reduce the height of the guard cover, thereby causing the grinding wheel 3 to be relatively protruded out of the guard cover 4 and consequently bringing the grinding wheel 3 in contact with the workpiece. As a result, swarf particles are brought about by grinding the workpiece with the rotating grinding wheel 3; nevertheless, the swarf particles flow into the suction pipe 6 through the suction port 7 together with the air around the grinding wheel which is evacuated by driving the suction pump device, whereby the swarf particles are not scattered away and accordingly, the worker can be kept from being affected in his health. Furthermore, the guard cover 4 serves as a safeguard against a broken piece of the grinding wheel even if the grinding wheel should be broken off. This is because the guard cover 4 having the contractible portion capable of stably fulfilling its function can effectively fence the rotating grinding wheel 3.

In view of the fundamental construction of the foregoing protective device, it is also possible to provide a modified embodiment of the invention as described in the following.

Figure 3:
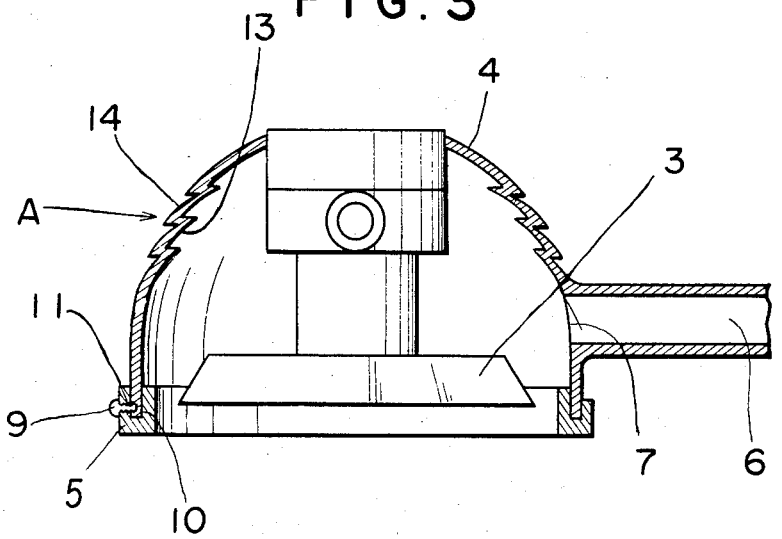
FIG. 3 is a broken away side view of another embodiment of the protective device according to this invention.

In the second preferred embodiment of this invention illustrated in FIG. 3, the contractible portion A of the guard cover 4 is formed in the shape of bellows, namely, composed of a plurality of constricted portions 13 and bulged portions 14. With this contractible portion, the guard cover 4 stably fulfils its function of preventing swarf particles brought about in grinding work from being scattered and safeguarding the worker against an accident such as breakage of the grinding wheel.

Particularly, in this embodiment, the guard cover 4 is provided at the lower edge portion with a reinforcing member 5. This reinforcing member 5 is formed of a metal or other hard material in the shape of a ring and has a circumferential channel 10 for admitting the lower edge of the guard cover 4 thereinto. The reinforcing member 5 functions to not only strengthen the guard cover 4, but also prevent the lower end portion from being worn away due to prolonged use. The reinforcing member 5 is detachably attached to the guard cover by means of screws 9 in tapped holes 11. Therefore, though the reinforcing member 5 is worn away with use, it can readily be detached from the guard cover 4 by loosening the screws 9 disposed on the periphery of the reinforcing member and replaced with new one. With this reinforcing member 5, the protective device of invention can be used over a long time.

Figure 4:
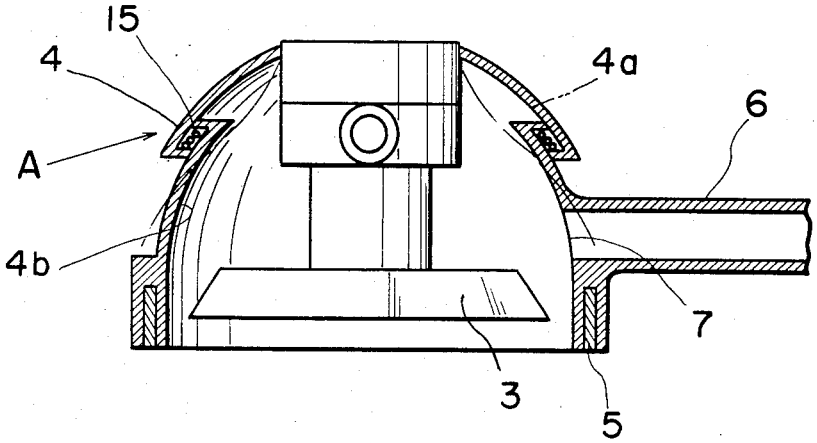
FIG. 4 is a broken away side view of still another embodiment of the protective device according to this invention.

The third preferred embodiment illustrated in FIG. 4 is so constructed that the guard cover 4 has the contractible portion A composed of an upper cup member 4*a* and a lower cylindrical member 4*b* which are telescopically connected with each other. Between the upper cup member 4*a* and the lower cylindrical member 4*b*, there is interposed a spring 15 for urging the lower cylindrical member 4*b* downwardly. When the guard cover 4 is pressed against the workpiece in use, the lower cylindrical member 4*b* is slidably admitted into the inside of the upper cup member 4*a* against the energizing force of the spring 15. The contractible portion A in this embodiment fulfils the same function as in the foregoing embodiment. Further, in this embodiment, the reinforcing ring 5 is made of a plate of metal or hard plastic such as ABS resin and embedded in the lower portion of the guard cover 4 in a partly exposed state.

Figure 5:
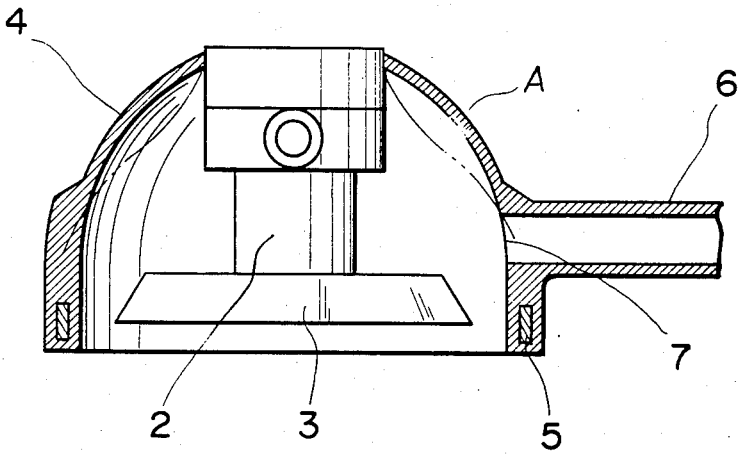
FIG. 5 is a broken away side view of yet another embodiment of the protective device according to this invention.

Referring to FIG. 5, another embodiment is shown wherein the contractible portion A is formed by making the thickness of the guard cover 4 thin. Thin walled portion serving as a contractible portion has sufficient elasticity and therefore, is readily deformed when the guard cover 4 is pressed against the workpiece in use.

Thus, the rotating grinding wheel 3 comes into contact with the workpiece thereby creating swarf particles of concrete, for instance, whereas the swarf particles are flow into the suction pipe 6 through the suction port 7 together with the air discharged by the suction pump device. In this embodiment, the reinforcing member 5 is completely embedded in the guard cover 4.

In either of the illustrated embodiments, the cup-shaped guard cover may be so designed as to have the lower end placed somewhat lower than or level with the lower surface of the grinding wheel.

As is clear from the description given above, the protective device to be attached to a grinder or the like has an outstanding advantage in that harmful swarf particles created by grinding or cutting a workpiece such as of concrete are prevented from being scattered in the air, thereby keeping a worker from being affected in health. The protective device of this invention further proves advantageous grinding of the workpiece without inviting danger of flying fragments of broken piece of the grinding wheel even when the grinding wheel is accidentally broken off.

What is claimed is:

1. A protective device for a grinder or the like, comprises a cup-shaped guard cover for enclosing a grinding wheel of the grinder, which is provided with a suction port communicating with a suction pump device and a contractible portion capable of being deformed or contracted so as to reduce the height of the cup-shaped guard cover, said cup-shaped guard covering having its lower end surface placed somewhat lower than or level with the lower surface of said grinding or cutting wheel, and said cup-shaped guard cover being made of elastic material and said contractible portion is formed by reducing the thickness of said guard cover in part at an upper portion thereof, whereby the height of the guard cover is elastically reduced when the guard cover is pressed against a workpiece.

2. A protective device according to claim 1, wherein said contractible portion comprises a plurality of circumferential grooves formed in the guard cover to form reduced thickness portions whereby the height of the guard cover is elastically reduced when the guard cover is pressed against a workpiece.

3. A protective device according to claim 1, wherein said cup-shaped guard cover is provided at the lower edge portion with a reinforcing member formed of hard material in the shape of a ring.

4. A protective device according to claim 3, wherein said reinforcing member is detachably attached to said cup-shaped guard cover by utilization of screws.

5. A protective device according to claim 3, wherein said reinforcing member is embedded in the guard cover.

6. A protective device for a grinder or the like, comprises a cup-shaped guard cover for enclosing a grinding wheel of the grinder, which is provided with a suction port communicating with a suction pump device and a contractible portion capable of being deformed or contracted so as to reduce the height of the cup-shaped guard cover, said cup-shaped guard cover having its lower end surface placed somewhat lower than or level with the lower surface of said grinding or cutting wheel, said cup-shaped guard cover being made of elastic material and said contractible portion is formed by reducing the thickness of said guard cover in part, whereby the height of the guard cover is elastically reduced when the guard cover is pressed against a workpiece, said cup-shaped guard cover being provided at its lower edge portion with a reinforcing member formed of hard material in the shape of a ring and said reinforcing member is embedded in the guard cover, said reduced thickness of said guard cover being provided at an upper portion thereof, and said suction port being in a lower portion of said guard cover.

* * * * *